US006771788B1

(12) United States Patent
Soutar et al.

(10) Patent No.: US 6,771,788 B1
(45) Date of Patent: Aug. 3, 2004

(54) SHIELDED MICROPHONE

(75) Inventors: Ian Soutar, Victoria (CA); Dennis Watkins, Brentwood Bay (CA); Bill Copeland, Victoria (CA)

(73) Assignee: Harman Becker Automotive Systems-Wavemakers, Inc., British Columbia (CA)

( * ) Notice: Subject to any disclaimer, the term of this patent is extended or adjusted under 35 U.S.C. 154(b) by 0 days.

(21) Appl. No.: 09/579,119

(22) Filed: May 25, 2000

(51) Int. Cl.[7] ..... H04R 25/00

(52) U.S. Cl. ..... 381/355; 381/189; 367/174

(58) Field of Search ..... 381/189, 334, 381/345, 346, 347, 355, 360, 361, 369, FOR 145, FOR 147, FOR 151; 128/201.19; 181/149; 367/141, 174

(56) References Cited

U.S. PATENT DOCUMENTS

| | | | | | |
|---|---|---|---|---|---|
| 4,123,622 | A | * | 10/1978 | MacLeod | 381/189 |
| 4,199,667 | A | * | 4/1980 | Renner | 381/355 |
| 4,845,760 | A | * | 7/1989 | Awakowicz et al. | 381/189 |
| 5,613,011 | A | * | 3/1997 | Chase et al. | 381/355 |
| 5,788,516 | A | * | 8/1998 | Uggmark | 439/86 |
| 5,808,243 | A | * | 9/1998 | McCormick et al. | 381/337 |
| 6,018,585 | A | * | 1/2000 | Akino et al. | 381/189 |
| 6,549,636 | B2 | * | 4/2003 | Fujimoto et al. | 381/361 |

* cited by examiner

*Primary Examiner*—Suhan Ni
(74) *Attorney, Agent, or Firm*—Brinks Hofer Gilson & Lione

(57) ABSTRACT

A microphone shield system is disclosed. The microphone shield system includes an impervious elastic membrane stretched over and covering a microphone on substantially all sides. The impervious elastic membrane is adapted to pass a selected acoustical frequency range. The selected acoustical frequency range excludes a frequency range of noise from environmental effects, such as wind and rain.

24 Claims, 7 Drawing Sheets

SHIELDED MICROPHONE

TECHNICAL FIELD

This invention relates to microphone shields, and more particularly to shielding a microphone from environmental effects.

BACKGROUND

High-quality reproduction of sound using available sound recording techniques and equipment is desirable in variety of applications. For example, high-quality, low-noise sound reproductions are important in television and movie industry, radio communication, and wireless telephone devices. Clean voice and dialog reproduction may be desired in the presence of ambient and background noise levels of moderate to high amplitude.

One frequently encountered source of undesirable background noise is caused by air or liquid moving relative to a sound-transducing device, such as a microphone. This type of noise may occur due to environmental conditions. For example, wind may cause distortion of the microphone-sensing membrane. Rain may also cause impact noise as drops of rain land on the microphone. Further, the combination of wind and rain may degrade the structure of the microphone with heat and moisture.

There are several prior art designs that have used open cell foam or cloth, known as a "wind sock" in the recording industry, to reduce the effect of wind noise on microphones. For example, in some embodiments, Drever (U.S. Pat. No. 4,600,077) and McCormick (U.S. Pat. No. 5,808,243). use "wind sock" designs that provide alternate layers of foam 102 and air spaces 104 to improve the microphone 100 performance (see FIG. 1). However, these techniques are often ineffective in wind conditions above approximately 10 kph.

Electronic filtering techniques have also been used to filter out wind noise. However, electronic filtering also attenuates desired audio frequencies, thereby substantially degrading sound quality.

SUMMARY

In recognition of the above-described problems with the prior designs, the inventors have developed a system that enables relatively low-noise microphone sensing in wind speeds of up to 80 kph, and in some cases, even beyond 80 kph. The inventors recognized that high wind conditions, above a wind speed threshold of about 10 kph, cause pressure imbalances between the front and rear sides of the microphone-sensing element.

The present invention includes a microphone shield system including an impervious elastic membrane stretched over and covering a microphone on at least one side. The impervious elastic membrane is adapted to pass a selected acoustical frequency range. The selected acoustical frequency range excludes a frequency range of noise from environmental effects, such as wind and rain.

The system also includes an opening to allow a plurality of wires to pass through the impervious-elastic membrane. The plurality of wires provides connections to the microphone.

The present invention also includes a method for shielding a microphone from noise created by environmental effects, such as wind and rain. The method includes stretching an impervious elastic membrane over the microphone to form an enclosure, and passing a plurality of wires through the impervious elastic membrane to provide connections to the microphone.

The present invention further includes a wireless telephone device. The device includes housing and communication electronics within the housing. The communication electronics provides transmission and reception of electronic signals. The device also includes a microphone and an impervious elastic membrane stretched over and covering the microphone on at least one side. The impervious elastic membrane is adapted to pass a selected acoustical frequency range, where the selected acoustical frequency range excludes a frequency range of noise from environmental effects, such as wind and rain.

The details of one or more embodiments of the invention are set forth in the accompanying drawings and the description below. Other features, objects, and advantages of the invention will be apparent from the description and drawings, and from the claims.

DESCRIPTION OF DRAWINGS

Different embodiments of the disclosure will be described in reference to the accompanying drawing wherein.

Like reference symbols in the various drawings indicate like elements.

DETAILED DESCRIPTION

Throughout this description, the embodiments and examples shown should be considered as examples rather than as limitations of the invention.

The present invention includes system and methods for achieving this improvement in wind noise immunity. For one embodiment, the present invention also provides physical isolation of the microphone from moisture to protect the microphone from the effects of rain and other moisture. In this embodiment, the system substantially reduces the sound of wind and raindrops striking the microphone.

Figure 1:
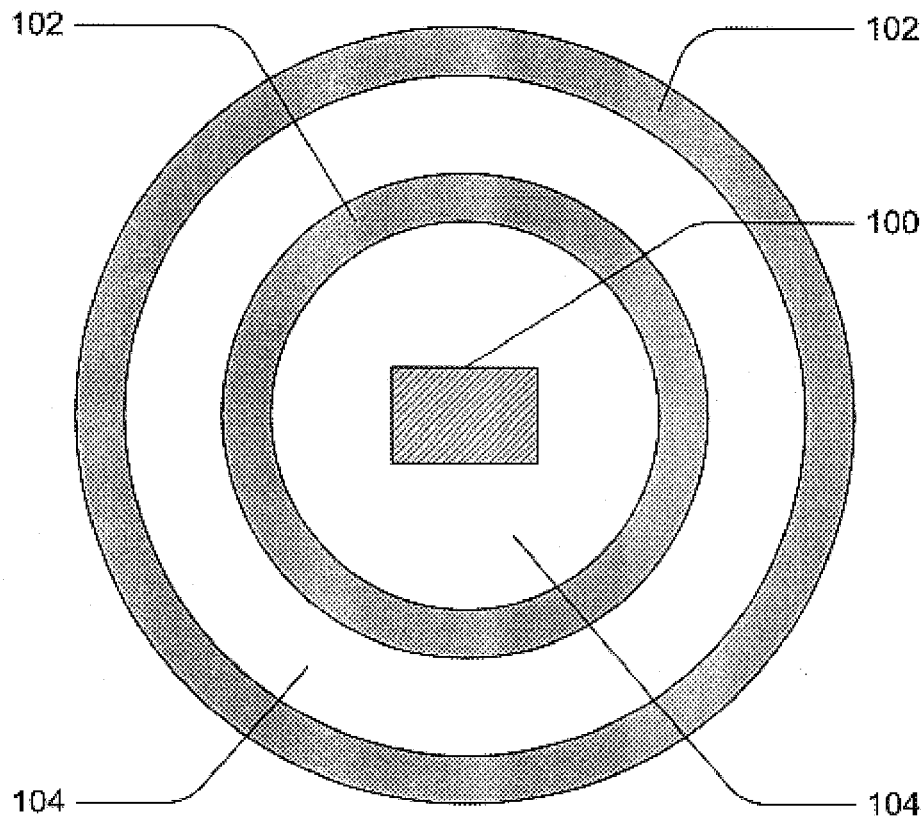
FIG. 1 (PRIOR ART)
FIG. 1 shows an embodiment of a prior art microphone shield design.
Figure 2:
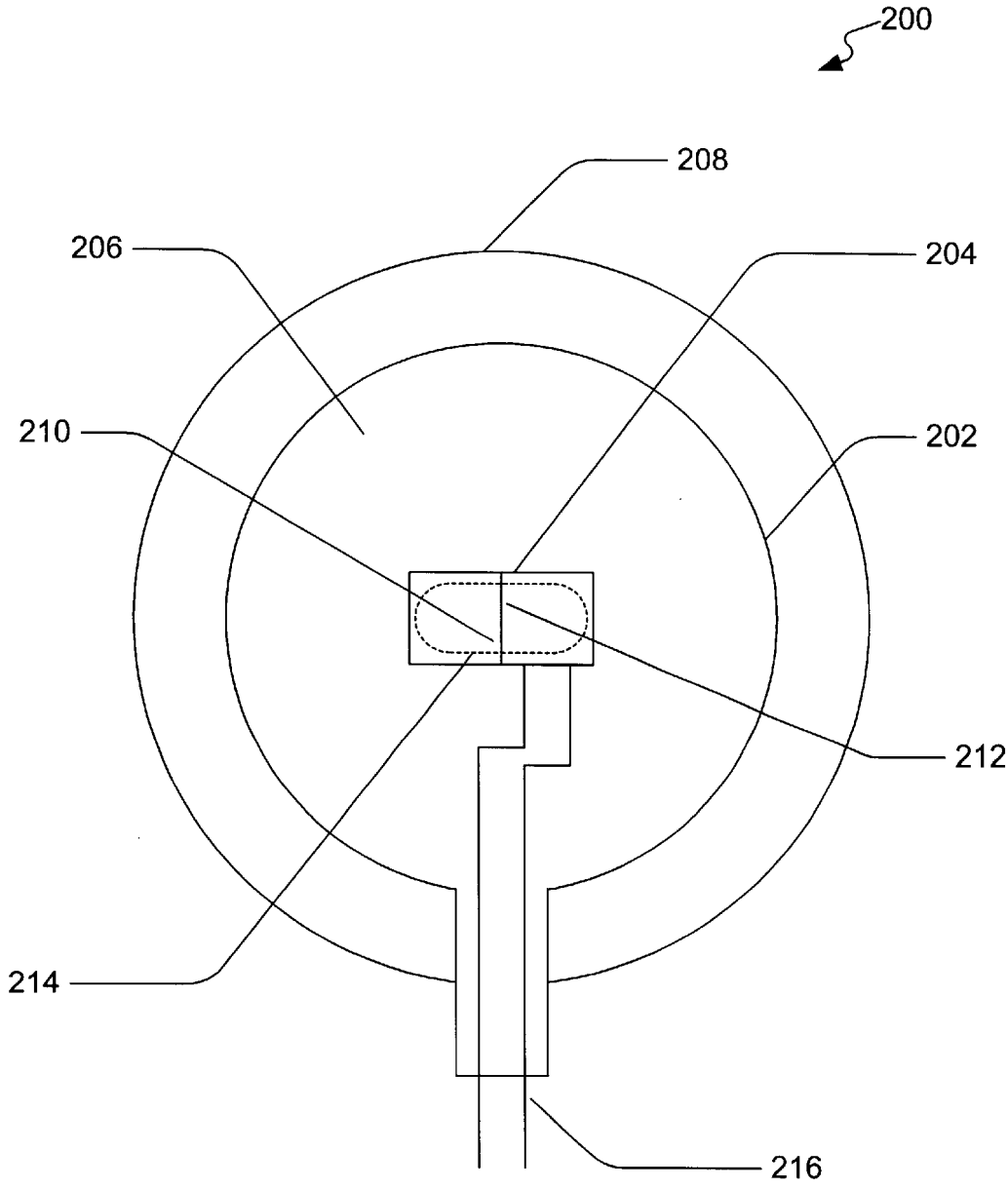
FIG. 2 shows a microphone shield system in accordance with an embodiment of the present invention.

An embodiment of the present system 200 is illustrated in FIG. 2. The system 200 includes an impervious elastic membrane 202 enclosing a microphone 204. This membrane 202 may include elastic material such as latex or synthetic rubber. In this embodiment, the latex or synthetic rubber membrane 202 is stretched over the microphone 204. The stretched membrane 202 may be supported over a frame or inflated with gas such as air. In some embodiments, the membrane 202 may be stretched over the microphone 204 by a pressure induced by gas such as air.

Sound waves pressing against the membrane 202 may cause the membrane 202 to vibrate. The vibration of the membrane 202 then transmits energy to the air inside the enclosure 206. Thus, the membrane 202 functions as a band-pass filter. This membrane 202 filters out unwanted noise from the acoustical signal reaching the microphone 204. The desired acoustical band may be selected by varying the thickness of the membrane 202.

For example, a balloon may be fully inflated to achieve a 100 Hz to 10 KHz band-pass. This band filters out unwanted low-frequency noise below 100 Hz. This membrane may be used in outdoor microphone sensing of ordinary speech and singing. If only ordinary speech were to be sensed, then a thicker and/or less stretched membrane may be used to pass frequencies from 300 Hz to 5 KHz. Thus, the frequency band of the filter is a function of both the thickness of the membrane and the tightness of the stretching.

In some embodiments, the use of the membrane 202 as a band-pass filter substantially reduces the low-frequency vibration from reaching the microphone 204. However, the vibration may create a resonance within the enclosure 206. Therefore, a layer of open-cell foam 208 or other porous material may be used to acoustically dampen the membrane's natural resonances. The foam 208 may be provided on the outside or the inside of the membrane 202.

The enclosure 206, formed by the membrane 202 and the foam 208, may further operate to reduce sub-sonic variations of air pressure. In particular, the sub-sonic variations between the front 210 and back 212 of the microphone's sensing element 214 may be substantially reduced. The reduction in air-pressure variations may reduce acoustical distortion caused by wind or rain noise at the microphone's sensing element 214. In addition, the membrane 202 may form a sealed enclosure 206 to protect the microphone 204 from environmental effects such as wind and/or rain.

For some embodiments, the membrane 202 forms an airtight or air-pressurized enclosure 206. Wires 216 from the microphone-sensing element 214 may be guided through the enclosure 206 for processing of the acoustical signal.

Figure 3:
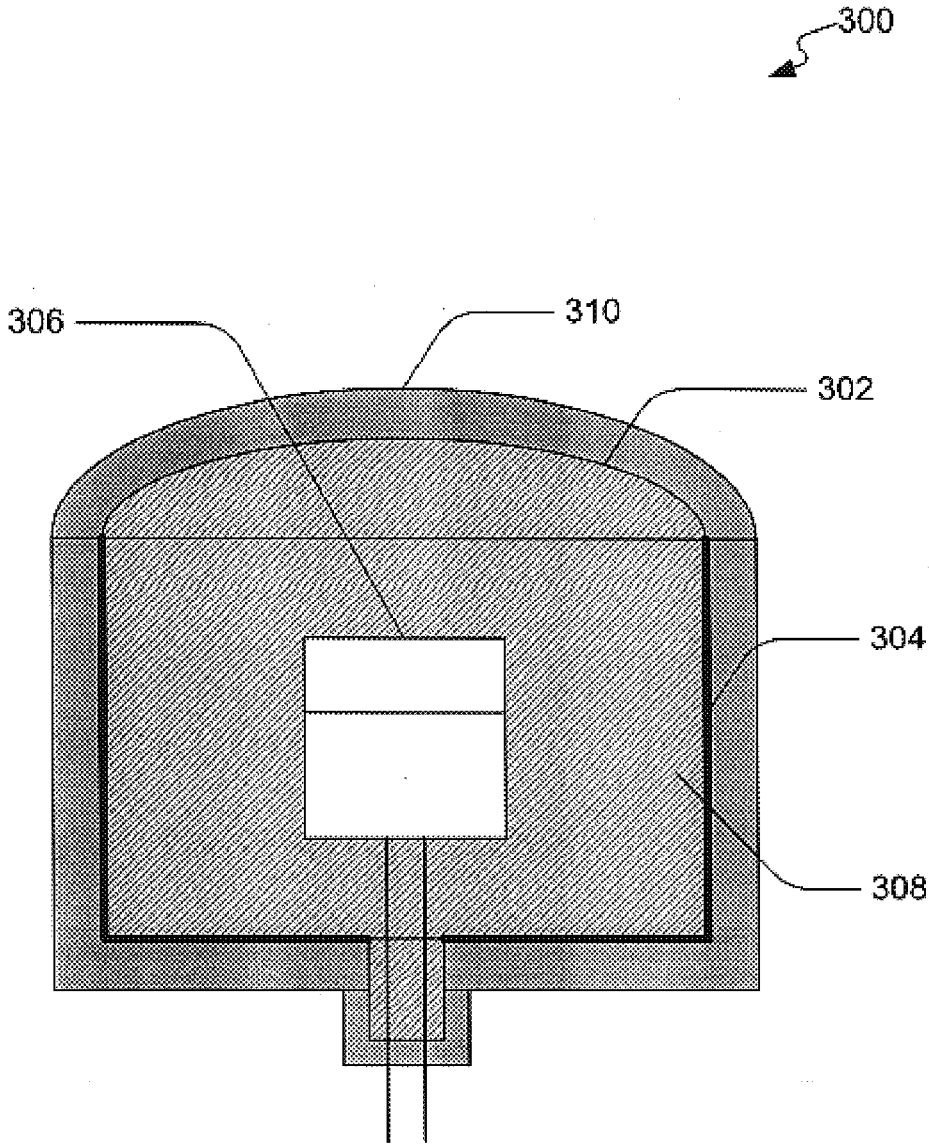
FIG. 3 shows a microphone shield system in accordance with another embodiment of the present invention.

FIG. 3 illustrates another embodiment of the present system. The system 300 includes an impervious elastic membrane 302 stretched over a chamber 304. The membrane 302 may include elastic material such as latex or synthetic rubber. This stretched membrane 302 may be supported over a frame above the chamber 304 or inflated with gas.

For one embodiment, this chamber 304 may include hard and rigid material for robustness in providing weather protection for a microphone 306. The chamber 304 may be cylindrical or spherical in shape. In some embodiments, the chamber 304 is pressurized with gas 308 above atmospheric pressure. Again, the membrane 302 and the chamber 304 may be lined with foam 310 to dampen the acoustical resonances.

Figure 4:
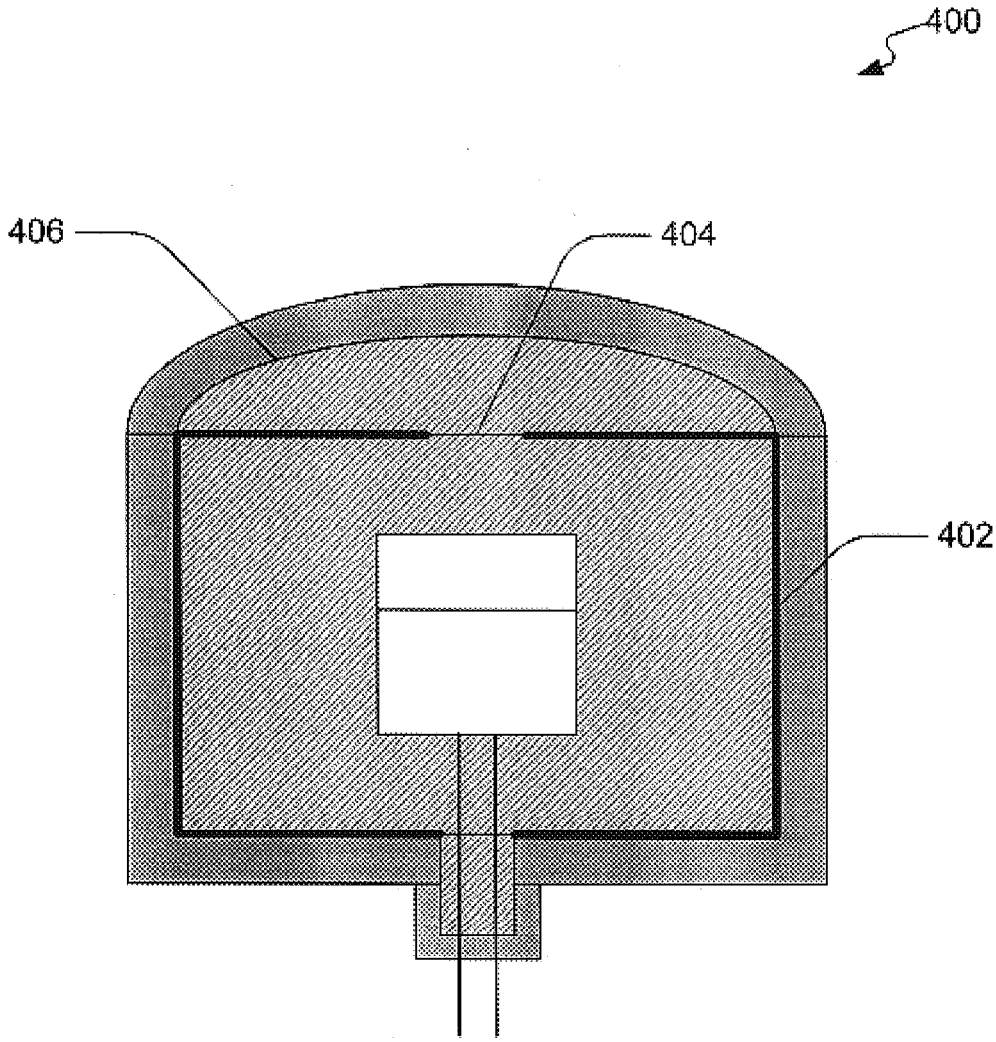
FIG. 4 shows a microphone shield system in accordance with yet another embodiment of the present invention.
Figure 5:
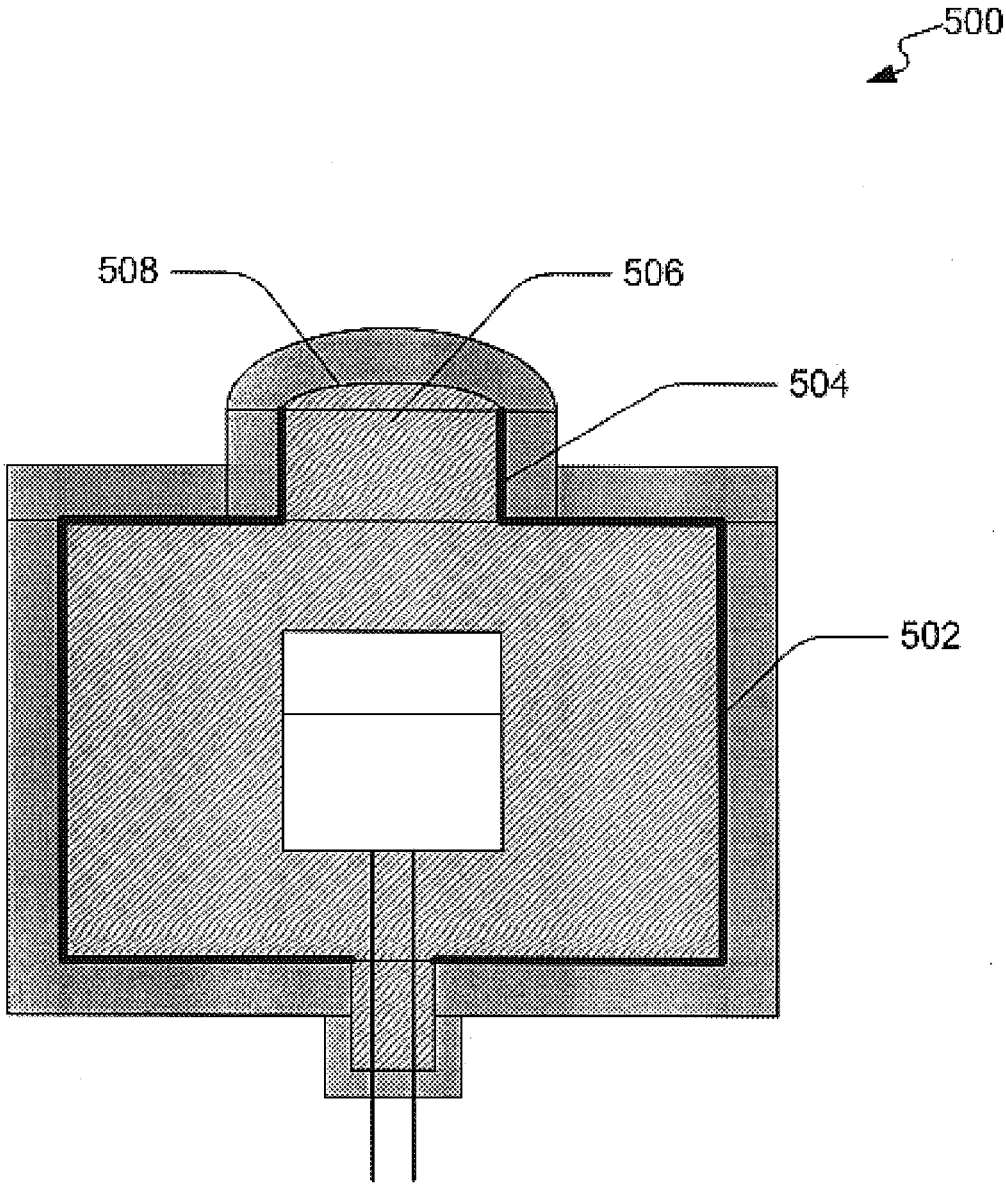
FIG. 5 shows a microphone shield system in accordance with yet another embodiment of the present invention.

Further embodiments of the present system are shown in FIGS. 4 and 5. The embodiment 400 is designed for a chamber 402 with smaller opening 404 than the embodiment 300. For this embodiment 400, the membrane 406 is stretched over the top of the chamber 402. T he embodiment 500 is designed for a chamber 502 with a neck 504, which provides an opening. 506. For this embodiment 500, the membrane 508 is stretched just over the opening 506. Again, the chamber 502 may be pressurized with gas above the atmospheric pressure.

Figure 6:
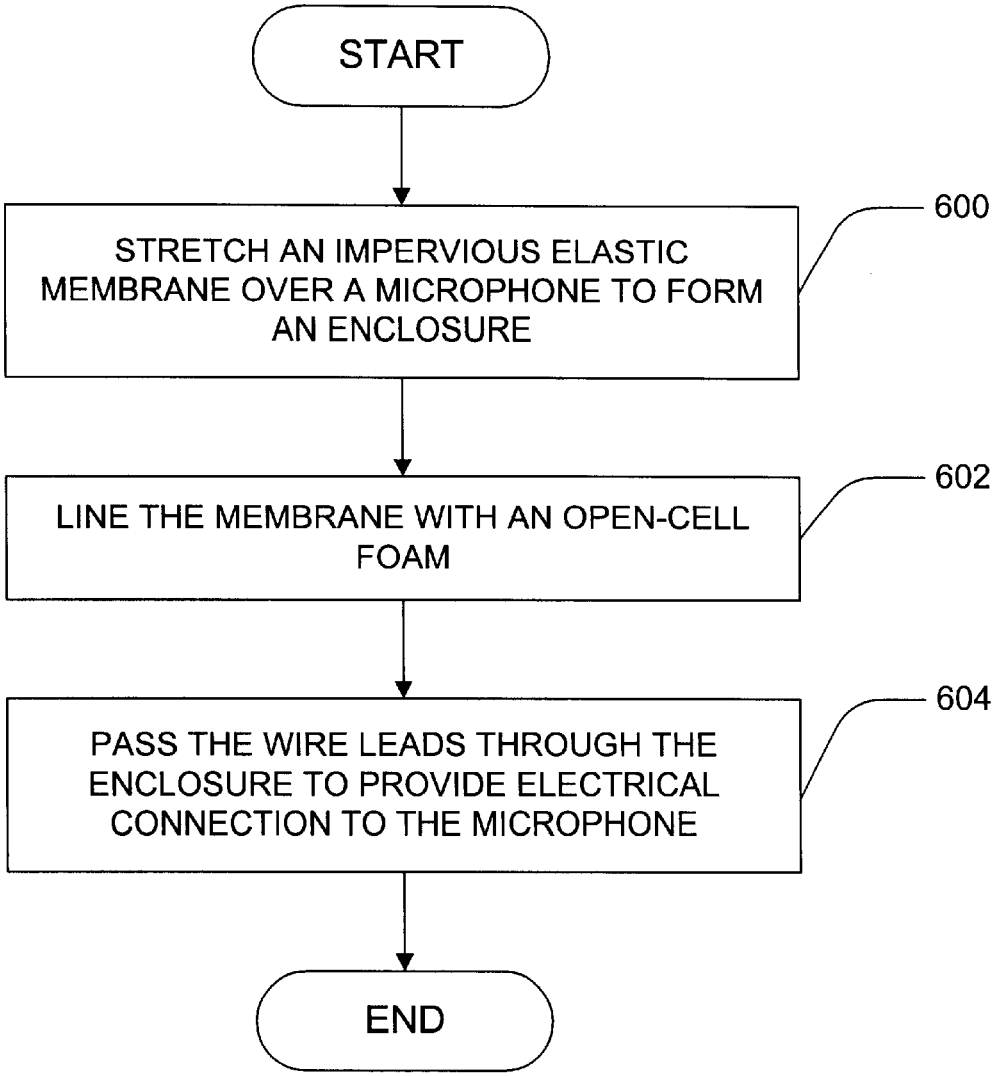
FIG. 6 is a flowchart of a method for providing a relatively low-noise microphone sensing in a high wind condition.

A flowchart of a method for providing a relatively low-noise microphone sensing in a high wind condition is shown in FIG. 6. The method includes stretching an impervious elastic membrane over a microphone to form an enclosure at step 600. At step 602, the membrane may be lined with open-cell foam. Finally, the wire leads are passed through the enclosure to provide electrical connection to the microphone at step 604.

Several embodiments of the microphone shield system have been discussed above. Such a shield system is contemplated for use in wireless telephone communications and radio communication equipment. In addition, the microphone shield system is also contemplated for use in connection with other technologies utilizing audio recording such as outdoor movie and news recording, and other applications.

Figure 7:
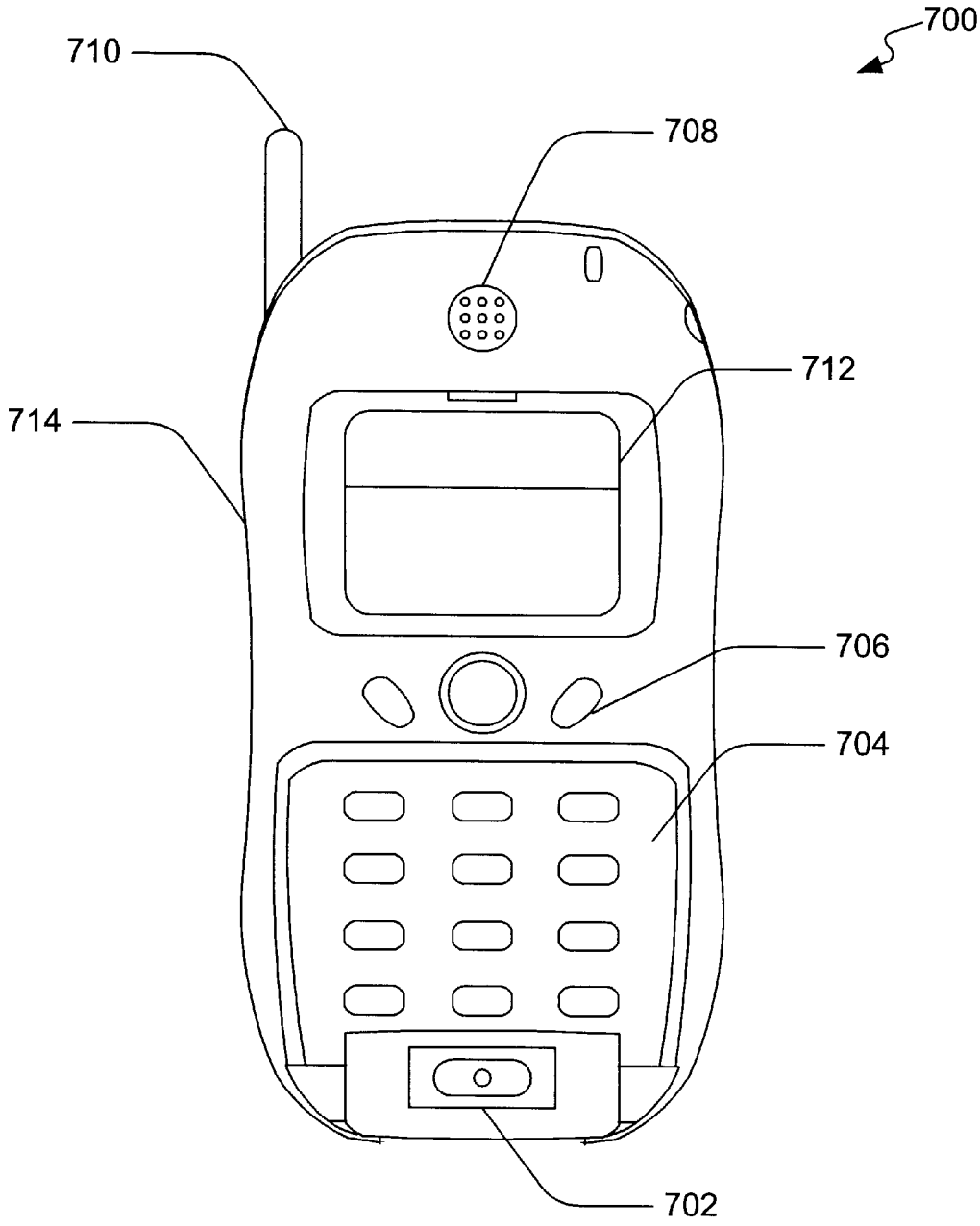
FIG. 7 is a front view of a wireless telephone device according to an embodiment of the present invention.

FIG. 7 shows a front view of a wireless telephone device 700. The wireless device 700 uses a microphone 702 enclosed with an impervious elastic membrane to filter out unwanted noise from the acoustical signal reaching the microphone 702. The wireless device 700 further includes a key pad. 704, various other buttons 706, a speaker 708, an antenna 710, a display 712, and communication electronics contained within a housing 714.

While specific embodiments of the invention have been illustrated and described, it will be obvious to those skilled in the art that various changes and modifications may be made without sacrificing the advantages provided by the principles disclosed herein. For example, even though the impervious elastic membrane has been described in terms of latex or synthetic rubber, other elastic material may be used as membrane. Accordingly, the invention may be embodied in other specific forms without departing from its spirit or essential characteristics.

What is claimed is:

1. A microphone shield system, comprising:

an inflated impervious elastic membrane stretched over and covering a microphone on at least one side, said impervious elastic membrane adapted to pass a selected acoustical frequency range, wherein the selected acoustical frequency range excludes a frequency range of noise from environmental effects; and an opening to allow a plurality of wires to pass through said inflated impervious elastic membrane, said plurality of wires providing connections to the microphone.

2. The system of claim 1, wherein said impervious elastic member covers the microphone on substantially all sides.

3. The system of claim 1, wherein said impervious elastic membrane is stretched over the microphone by a pressure induced by gas.

4. The system of claim 1, further comprising:

a porous foam coupled to said impervious elastic membrane, said porous foam adapted to acoustically dampen natural resonances of said impervious elastic membrane.

5. The system of claim 1, further comprising:

a frame configured to allow said impervious elastic membrane to form an enclosure around the microphone.

6. The system of claim 5, wherein the enclosure is substantially sealed to protect the microphone from rain.

7. The system of claim 1, wherein said impervious elastic membrane is inflated with air to form an enclosure around the microphone.

8. The system of claim 7, wherein the enclosure is substantially sealed to protect the microphone from moisture.

9. The system of claim 1, wherein said impervious elastic membrane is pressurized with gas to form an enclosure around the microphone.

10. A shield system for a sound transducing device, comprising:

a chamber having a first opening, and adapted to provide an enclosure for the sound transducing device; and an inflated impervious elastic membrane stretched over the first opening of said chamber, said inflated impervious elastic membrane adapted to pass a selected acoustical frequency range, where the selected acoustical frequency range excludes a frequency range of noise from environmental effects.

11. The system of claim 10, wherein said chamber is hard and rigid.

12. The system of claim 10, wherein the sound transducing device is a microphone.

13. The system of claim 10, wherein said chamber is gas-pressurized above atmospheric pressure.

14. The system of claim 10, wherein said chamber has a second opening to pass a plurality of wires providing connections to the sound transducing device.

15. A method for shielding a microphone from noise created by environmental effects, comprising:

inflating an impervious elastic membrane over the microphone to form an enclosure, said impervious elastic membrane adapted to pass a selected acoustical frequency range excludes a frequency range of noise from environmental effects; and passing a plurality of wires through said impervious elastic membrane to provide connections to the microphone.

16. The method of claim 15, wherein said inflating includes pressurizing the impervious elastic membrane with gas.

17. The method of claim 15, further comprising:

covering said enclosure with a porous material.

18. The method of claim 17, further comprising:

lining an inside surface of said impervious elastic membrane with damping material porous to sound.

19. The method of claim 15, further comprising:

lining an inside surface of said impervious elastic membrane with damping material porous to sound.

20. A method for shielding a microphone from a high wind condition, comprising:

inflating an impervious elastic membrane over the microphone to form an enclosure, said impervious elastic membrane adapted to pass a selected acoustical frequency range, wherein the selected acoustical frequency range excludes a frequency range of noise from environmental effects;

coupling a porous foam to said impervious elastic membrane, said porous foam adapted to acoustically dampen natural resonances of said impervious elastic membrane; and passing a plurality of wires through said impervious elastic membrane to provide connections to the microphone.

21. A method for shielding a microphone from a high wind condition, comprising:

enclosing the microphone in a chamber with an opening;

inflating an impervious elastic membrane over said opening of the chamber, said impervious elastic membrane adapted to pass a selected acoustical frequency range, wherein the selected acoustical frequency range excludes a frequency range of noise from environmental effects; and coupling a porous foam to said impervious elastic membrane, said porous foam adapted to acoustically dampen natural resonances of said impervious elastic membrane.

22. The method of claim 20, wherein said impervious elastic membrane is stretched over the microphone by a pressure induced by gas.

23. The method of claim 21, wherein said impervious elastic membrane is stretched over the microphone by a pressure induced by gas.

24. The method of claim 21, further comprising:

covering the chamber and the impervious elastic membrane with open-celled foam or other porous material.

* * * * *